US009009931B2

(12) United States Patent
Jensen

(10) Patent No.: US 9,009,931 B2
(45) Date of Patent: Apr. 21, 2015

(54) VERSATILE, CONVERTIBLE MESSENGER BAG

(71) Applicant: Matthew Jensen, Ann Arbor, MI (US)

(72) Inventor: Matthew Jensen, Ann Arbor, MI (US)

( * ) Notice: Subject to any disclaimer, the term of this patent is extended or adjusted under 35 U.S.C. 154(b) by 242 days.

(21) Appl. No.: 13/783,207

(22) Filed: Mar. 1, 2013

(65) Prior Publication Data

US 2013/0277405 A1 Oct. 24, 2013

Related U.S. Application Data

(60) Provisional application No. 61/605,402, filed on Mar. 1, 2012.

(51) Int. Cl.

| | |
|---|---|
| ***A45C 13/30*** | (2006.01) |
| ***A45F 3/02*** | (2006.01) |
| *A45F 3/04* | (2006.01) |

(52) U.S. Cl.
CPC . *A45C 13/30* (2013.01); *A45F 3/02* (2013.01); *A45F 3/047* (2013.01)

(58) Field of Classification Search
USPC ..... 24/614, 615, 625
See application file for complete search history.

(56) References Cited

U.S. PATENT DOCUMENTS

| | | | | |
|---|---|---|---|---|
| 4,064,603 | A | 12/1977 | Romanzi, Jr. | |
| 4,793,032 | A | 12/1988 | Crowle | |
| 5,077,839 | A * | 1/1992 | Keller | 2/421 |
| 5,263,234 | A * | 11/1993 | Fudaki | 24/662 |
| 5,319,836 | A * | 6/1994 | Ida | 24/625 |
| D349,871 | S | 8/1994 | Murai | |
| 5,450,661 | A | 9/1995 | Rekuc | |
| 5,471,716 | A | 12/1995 | Takahashi | |
| 5,564,131 | A * | 10/1996 | Anscher | 2/340 |
| 5,855,057 | A * | 1/1999 | Anscher | 24/614 |
| 5,860,769 | A | 1/1999 | Seligman | |
| 6,360,404 | B1 * | 3/2002 | Mudge et al. | 24/3.4 |
| 6,802,109 | B2 | 10/2004 | Hede et al. | |
| 2006/0070215 | A1 * | 4/2006 | Sung | 24/615 |
| 2009/0255101 | A1 * | 10/2009 | Lin | 24/614 |

FOREIGN PATENT DOCUMENTS

| | | |
|---|---|---|
| EM | 1196055 A2 | 4/2002 |
| EM | 1465507 A1 | 10/2004 |

* cited by examiner

*Primary Examiner* — Victor Batson
*Assistant Examiner* — David Upchurch
(74) *Attorney, Agent, or Firm* — Rader, Fishman & Grauer PLLC

(57) ABSTRACT

A strapping system used to hold a messenger bag or the like to a person. The system includes multi-component multi-attachment rotating and detachable buckles which provide pivoting motion about the intersection points of non-axial forces. The system allows for switching shoulders and adjusts to changing angles induced by changing the position of the bag on the person.

11 Claims, 7 Drawing Sheets

VERSATILE, CONVERTIBLE MESSENGER BAG

1. FIELD OF THE INVENTION

The present invention relates to the strapping system used to hold a messenger bag to a person. Messenger bags are not unique in their strapping system which is shared with so-called duffle bags and diaper bags among others.

2. DESCRIPTION OF PRIOR ART

So called D-ring and swivel hook assemblies provide a D-ring attachment which is permanently affixed to a bag. Utilizing a swivel hook in conjunction with said D-ring provides swiveling motion to the attachment system.

U.S. Pat. No. 5,450,661 to Richard Rekuc provides a swivel hook comprised of a hook with a safety catch device to prevent accidental unhooking along with a swiveling pivot facilitating spinning motion about the strapping axis.

U.S. Pat. No. 4,793,032 to William G. Crowle provides a buckle device utilizing a single cam means for disengaging a tab from a slot.

International Patent Publication number EP1465507 B1 to Jean-Marc Hede and Paul Petzl provides a fixing buckle for self-locking and adjusted fastening of a belt, comprising a base equipped with a hook for catching a retaining ring.

U.S. Pat. No. 4,064,603 to Louis Romanzi, Jr. provides a buckle with a center button which disengages the buckle when depressed.

U.S. Pat. No. 5,471,716 to Yoshinobu Takahashi provides a buckle having the ability to swivel about two axes and featuring a center release mechanism.

U.S. Pat. No. D349871 to Ryukichi Murai provides the ornamental design of a buckle having the ability to pivot about one axis.

U.S. Pat. No. 5,860,769 to Scott P. Seligman provides the use of a buckle with the ability to pivot about one axis in a scuba diving backpack.

International Patent Publication number EP1196055 B1 to Jr. L. Arthur Gehr, E. Glenn Gehr, A. James Sack provides the design a multi-point buckle assembly.

3. CRITIQUE OF PRIOR ART

Prior art encompasses the usages of strapping systems and buckle designs which have the ability to swivel/rotate about multiple axes, join multiple straps through a single buckle, be released through the depression of a center button, and connect through a hook and ring assembly. What is lacking in the prior art is the ability to facilitate unimpeded pivoting at the joints of the strapping system through detachable buckles where the pivoting motion occurs at the intersection of axial forces transferred through the straps. For instance, A D-ring system allows for 90 degrees of rotation, but full rotation is not possible about a D-ring without the addition of an inline swivel. Furthermore, it is not a system which is well controlled. The clasping device rattles around and frequently has inches of play. This uncontrolled motion can lead to the accidental disconnection of the clasp from the D-ring. Furthermore, while articulating buckle designs exist, they only allow for a limited range of pivoting motion, and the pivot motion it is not about an intersection of axial forces. In a strapping system, when a non axial force is applied to a strap the strap bends at the point where the force is applied. Straps are unable to transfer cantilevered forces, therefore, radiating away from any intersection point all forces are axial. When forces are axial no pivoting motion will be induced. In order for a pivoting buckle to be effective non axial forces must be directed into the buckle itself and not into the connecting strapping. A buckle installed inline on a strap does not utilize its ability to rotate thus rendering it useless in providing a strapping system with the ability to pivot without kinking the straps.

3. SUMMARY OF THE INVENTION

So-called messenger bags have become quite popular, not only for individuals who use them to carry goods from place to place as part of an occupation, but also by bicyclists, students, and others who need to carry books and other articles.

Some messenger bags have strap connectors on both sides at the top of the bag enabling a user to switch positions between their right and left shoulders. Better messenger bags eliminate the beneficial ability to switch shoulders in order to possess a third stabilizing strap which connects from one side of the bottom of the bag to the main strap across the chest of the wearer, such that the bag is maintained in a comfortable, somewhat diagonal orientation across the wearer's back.

One of the problems with existing messenger bags is that the straps can be wide and the connectors used to connect the straps to the bag do not facilitate rotation. As such, particularly when the user shifts the straps from one shoulder to another, the straps get kinked or curled resulting in an arrangement that might be uncomfortable, inconvenient or damaging to the strap.

Another problem with existing messenger bags is that when a third stabilizing strap is utilized it becomes time consuming, difficult or impossible to change position of the bag between shoulders.

4. BRIEF DESCRIPTION OF THE DRAWINGS

Figure 12A:
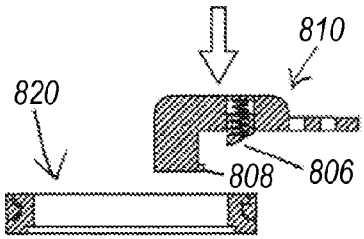
Figure 12B:
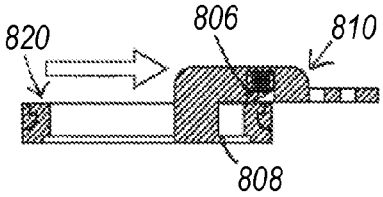
Figure 12C:
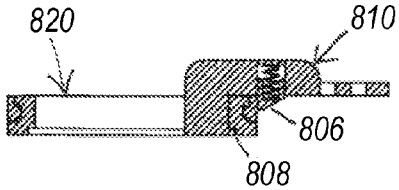

FIGS. 12A-C show a centerline cross sectional view of a multi rotational coupler.

Figure 13A:
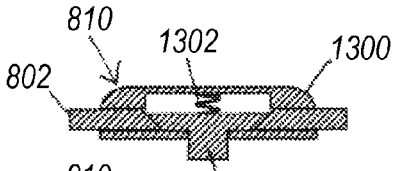
Figure 13B:
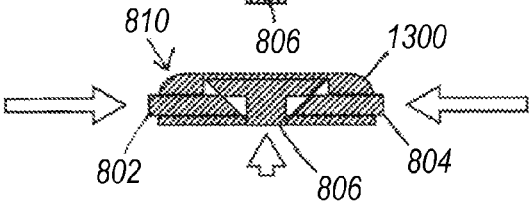

FIGS. 13A-B show motion for engaging components with a locking pin.

5. DETAILED DESCRIPTION OF THE INVENTION

This invention resides in a messenger bag system that not only enables a more streamlined and satisfying shifting of the bag from one shoulder to the other, but also with connectors and fasteners that facilitate rotation, thereby avoiding the problem of the straps becoming uneven or kinked during use. While the various connectors and fasteners disclosed herein may be used together in a comprehensive messenger bag arrangement, the connectors and fasteners are also patentably distinct in the sense that they may be used individually, either in a messenger bag configuration or in other applications which might benefit from such components.

Figure 1A:
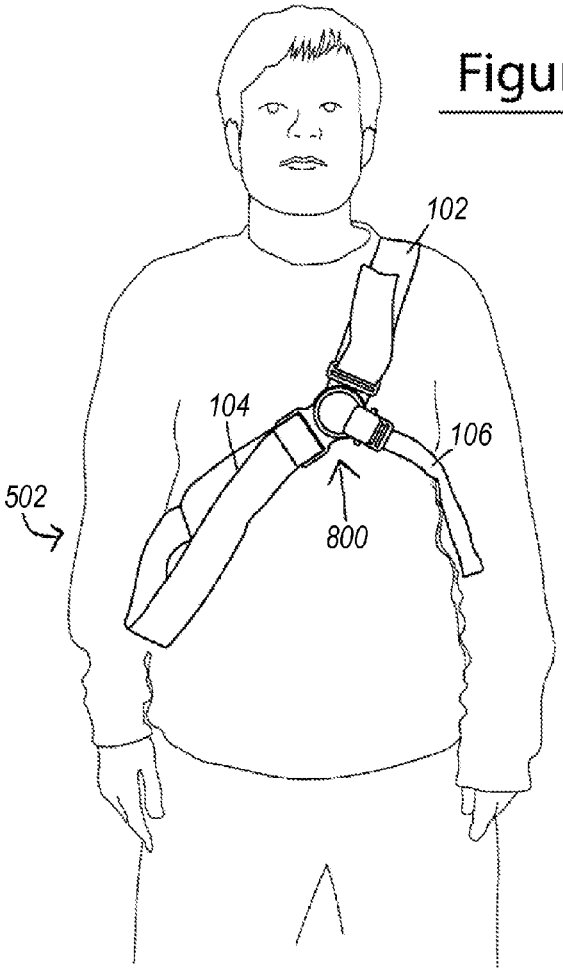
FIG. 1A is a drawing of a person seen from the front wearing an exemplary messenger bag.
Figure 1B:
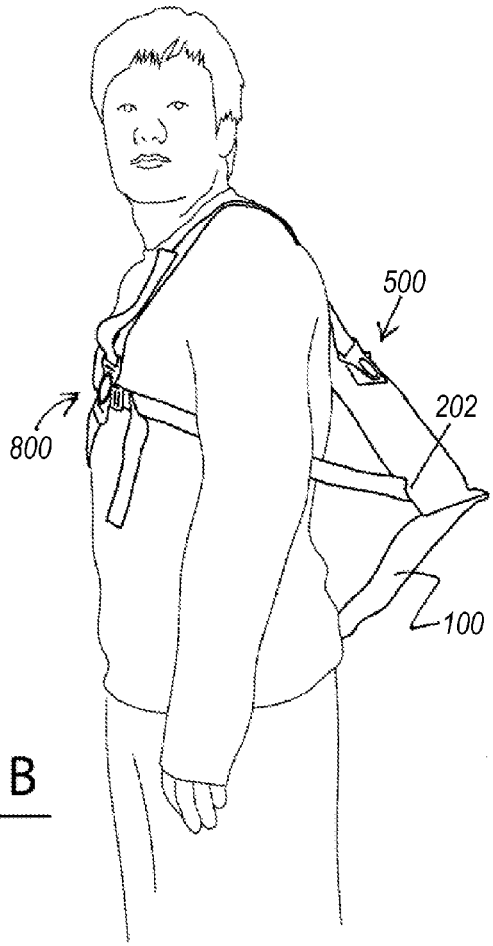
FIG. 1B is a side view of the person shown in FIG. 1A.
Figure 2:
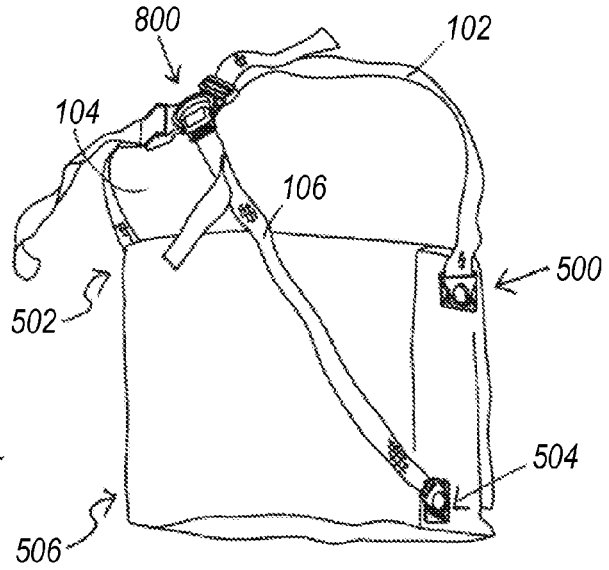
FIG. 2 is a drawing of the exemplary messenger bag system without the wearer.

FIG. 1A is a drawing of a person seen from the front wearing a messenger bag according to the invention. FIG. 1B is a side view of the individual in FIG. 1A. FIG. 2 is a drawing which shows the messenger bag system without the wearer. The complete system includes a primary strap unit split into two straps 102 and 104, and a third, stabilizing strap 106. At a given time, primary strap 102 is positioned over one shoulder of the user, with strap 104 coursing around the opposite side of the wearer.

In FIG. 1A, for example, strap 102, connected to the bag 100 at 500, is dressed over the user's left shoulder, with strap 104 going around the user's right side, connecting to point 502 on bag 100. Strap 106, connected to the bottom of the bag 100 at 202 comes around the user's left side, connecting to straps 102, 104 with coupling 800, resulting in a somewhat diagonal, stable positioning of the bag across the user's back. When the user switches shoulders, the straps are detached and rearranged so that they perform the same functions on the other side of the body in mirror image fashion.

In accordance with the invention, one end of straps 102, 104, 106 are connected to the bag 100 through inventive quick-release swivel couplings 500, 502, 504, 506. The other ends of the straps 102, 104, 106 are not connected to the bag 100 but are instead attached to one another through an inventive multi-rotatable coupling 800. One end of the third, stabilizing strap 106 connects to the multi-rotatable coupling with the other end of 106 being connected near the bottom of the bag 100 on one side or the other by quick-release swivel coupling 504 and 506 pictured in FIG. 2. Quick-release swivel coupling 504 and 506 are identical and thus may be connected interchangeably. All of the various couplings and component parts of the quick-release swivel couplings may be constructed of any suitable material(s), including plastics and metals.

Figure 3:
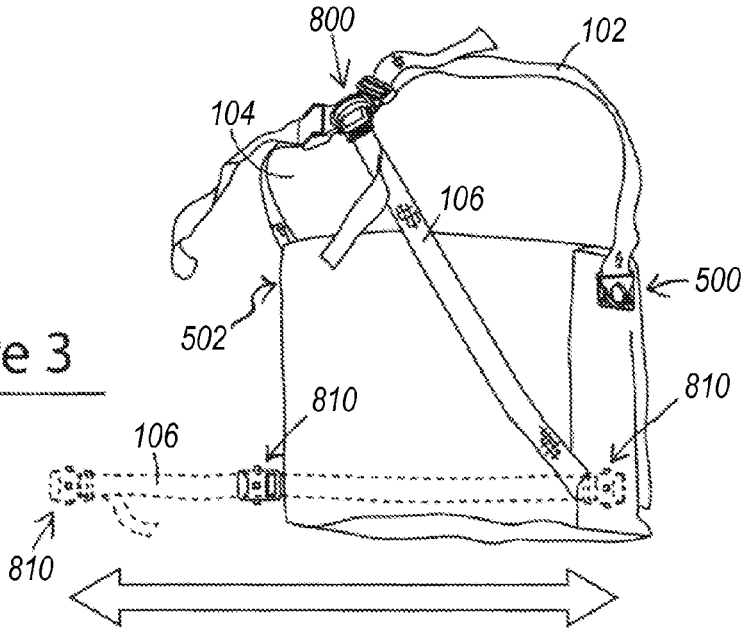
FIG. 3 illustrates a system having a continuous strap at both ends.

The attachment of strap 106 to the bag 100 may be achieved through multiple methods. In FIG. 3 a system is demonstrated featuring a longer, continuous strap having a connector 810 at both ends with the ability to slide from side to side. This configuration facilitates a free-sliding motion allowing for a quick switch of sides for this strap when the user switches shoulders. To activate this feature the user simply pulls from the side they wish the strap to be on.

Figure 4:
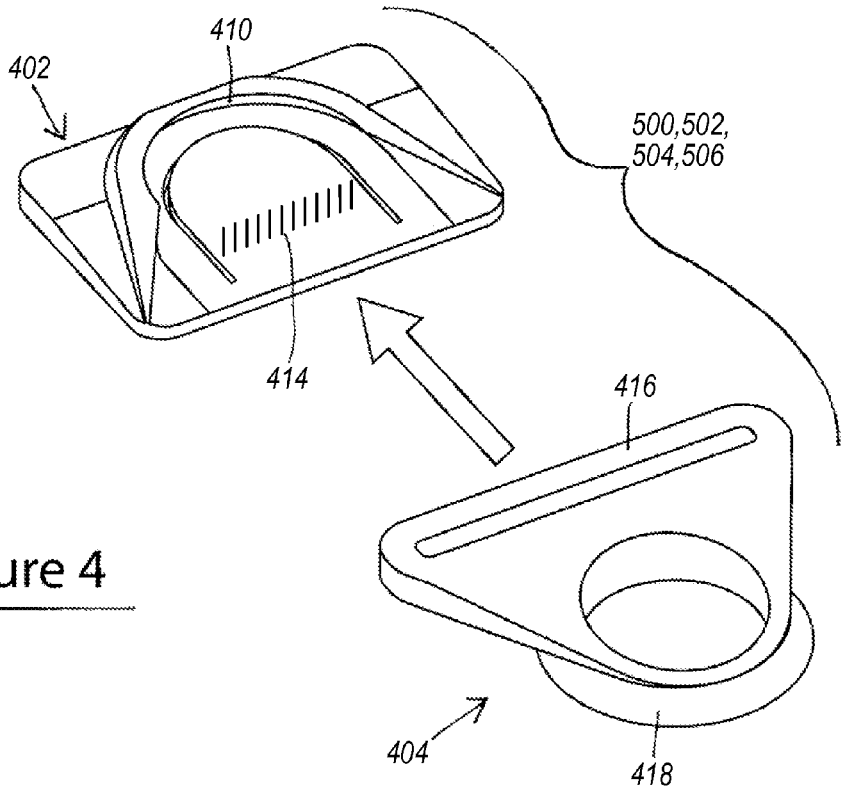
FIGS. 4 and 5 illustrate couplers in an oblique, disconnected state.
Figure 5:
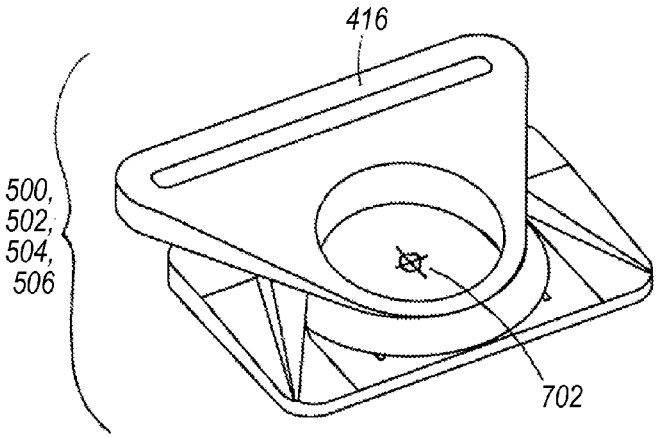

FIG. 4 is a drawing of couplers 500/502/504/506 in an oblique, disconnected state, while FIG. 5 is a drawing of couplers 500/502/504/506 in an oblique connected state.

Figure 6A:
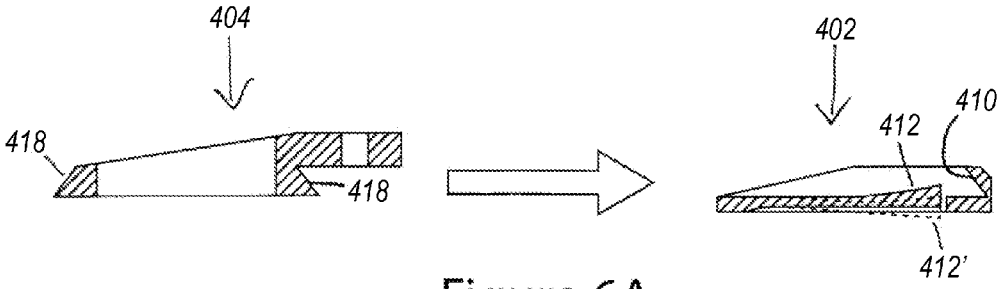
FIGS. 6A and 6B illustrate cross sectional views of couplers showing parts in cooperation with one another.
Figure 6B:
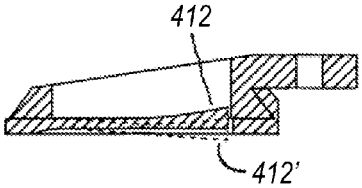
Figure 7:
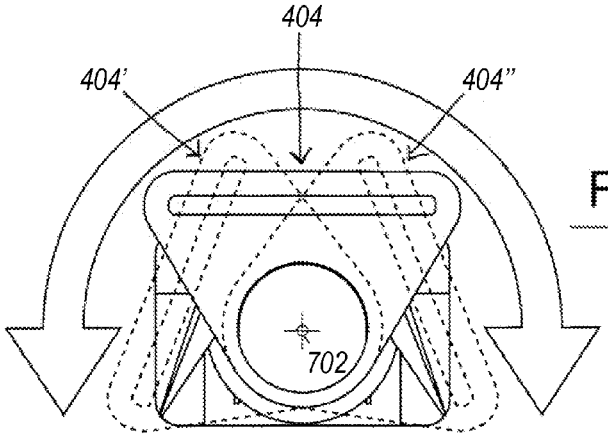
FIG. 7 shows independent component rotation of component parts of FIGS. 4 and 5.

FIGS. 6A and 6B are a cross sectional view of the couplers from FIG. 4 and FIG. 5 showing the way in which the component parts cooperate with one another. FIG. 7 shows how, through such cooperation, piece 404 may be rotated independently of piece 402 as shown by broken-line representations 404', 404". In the preferred embodiment, when the two components are fully coupled together capacity for rotational motion is unimpeded and continuous. Alternate embodiments may feature limited rotation achieved through the use of mechanical stops. The Point 702 is the intersection of axial forces exerted by straps 102, 104, and 106 upon the bag. It is also the internal pivot point of the quick-release swivel couplings. By positioning these points to be overlapping when non-axial forces are introduced into the strapping system a pivoting motion is induced in the quick-release swivel coupling and forces in the strapping return to an axial state.

The couplers are comprised of two portions. The first portion 402 is attached to the bag 100 at the various attachment points. The methods of attachment may include mechanical fasteners such as rivets or screws. Alternate adhesive means may include glue, thermal bonding, or a sewn connection. Any attachment method may be combined with any combination of the other methods to achieve a suitable attachment. For instance, the coupler part 402 may be thermally bonded to a section of strapping which is then sewn to the bag 100. The component 402 includes an integrally formed curved portion 410. In the preferred embodiment, this curve is substantially circular, though non-circular portions may be used to resist rotation as a function of rotational angle. When component 404 is inserted into component 402, the circular portions 410 and 418 mate to provide the primary mechanical coupling. A living hinge 414 allows the raised portion 412 of component 402 to be moved out of the way 412' until the two components are fully seated. At which point the living hinge 414 causes the raised portion 412 to spring back into position providing a catch which secures the two pieces together preventing decoupling as shown in FIG. 6B. To remove component 404 from the other component 402, one need only press down on Point 702 with a finger, for example, to facilitate a quick release thereof.

Component 404 features a bar 416 which serves as a mounting platform for straps 102,104, or 106. However, this bar may be eliminated if other attachment means are used such as pinching, riveting, screwing, gluing or thermal bonding.

Figure 8A:
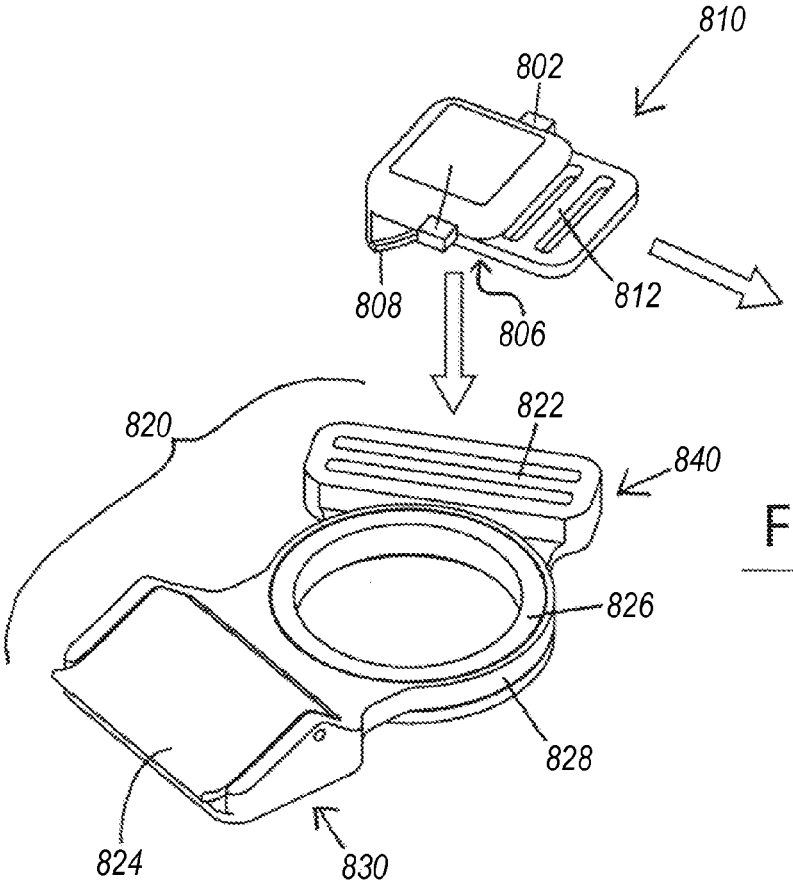
FIGS. 8A and 8B shows an oblique drawing for a multi-rotational coupler.
Figure 8B:
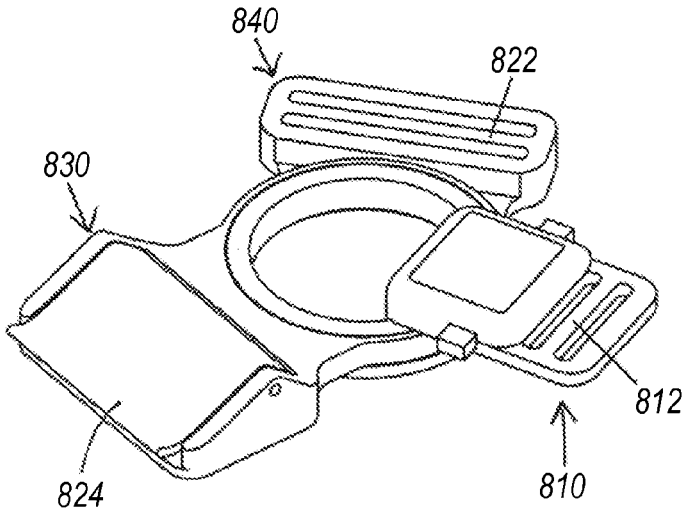

FIGS. 8A and 8B are detailed, oblique drawings of the preferred embodiment for said multi-rotational coupler 800 showing the action for joining a connector component 810 to a base component 820. FIG. 8A shows the two components in a separated state and indicates the motion which engages them. FIG. 8B shows the components in an engaged state. Note that the connector component 810 is shown in FIG. 8B to be connected to the base component 820 on the right side. In the preferred embodiment, and due to the symmetrical nature of the design this attachment may also occur on the left side effectively in a mirror image orientation. All of the various couplings and component parts of the multi-rotational coupler may be constructed of any suitable material(s), including plastics and metals.

The multi rotational coupler base unit 820 features an adjustable mounting point 822 to which strap 102 is attached, and an adjustable mounting point 824 to which strap 104 is attached. In the preferred embodiment mounting point 822 is a typical strapping ladder lock style mount while mounting point 824 is a typical strapping cam lock style mount. The multi rotational coupler connector component 810 features an adjustable mounting point 812 to which strap 106 is attached. In the preferred embodiment mounting point 812 is a typical strapping ladder lock style mount. The various aforementioned adjustable mounting points allow for the entire strapping system to be tightened and loosened in a multitude of ways thus allowing the system to be custom fit and adjustable to accommodate the physique of a particular user.

Figure 9:
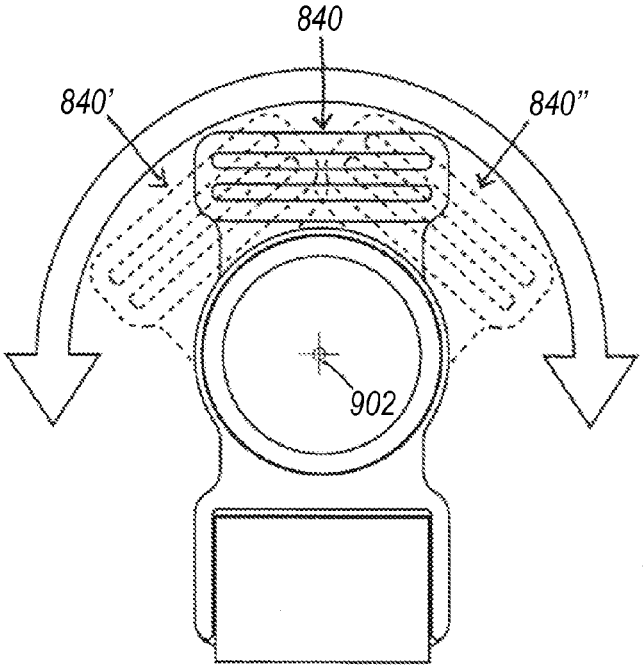
FIG. 9 shows components of FIG. 8A in various positions of rotation.

The multi rotational coupler base unit 820 is comprised of two pieces 830, and 840 which allows for the ability of the component to swivel. In FIG. 9 piece 840 is shown to be in various rotated states 840', and 840" this rotation happens about Point 902. In the preferred embodiment the two pieces are permanently locked together with the ability to pivot. In other embodiments the two pieces 830, and 840 may feature the ability to disengage from one another while still allowing for the pivot motion when engaged.

Figure 10:
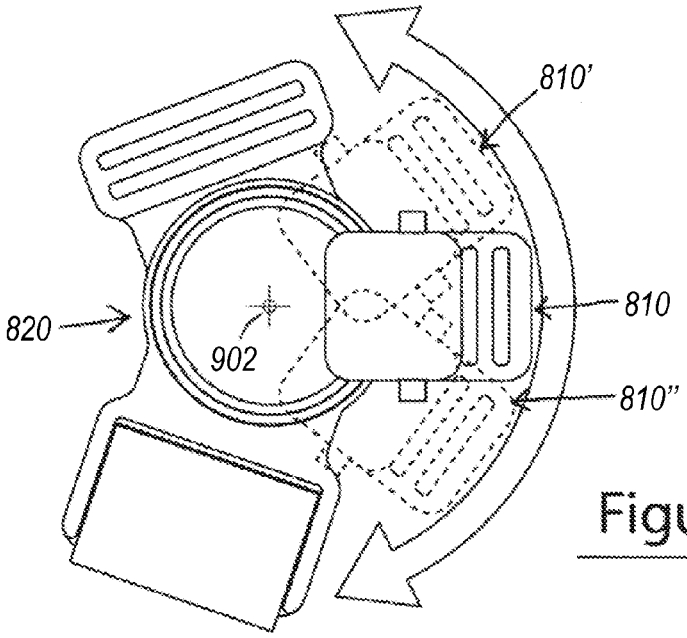
FIG. 10 shows components of FIG. 8B in various positions of rotation.

FIG. 10 demonstrates the ability of the connector component 810 to rotate in its connection to base component 820. The various rotated states 810', and 810" demonstrate the motion where the connector component remains affixed to the ring structure of the base component, and by sliding along this ring, a rotation is induced about the pivot Point 902. The Point 902 is also the intersection of axial forces transferred to multi rotational coupler by straps 102,104, and 106. By positioning these points to be overlapping when non-axial forces are introduced into the strapping system, pivoting motion is induced in the multi rotational coupler and forces in the strapping system return to an axial state.

Figure 11:
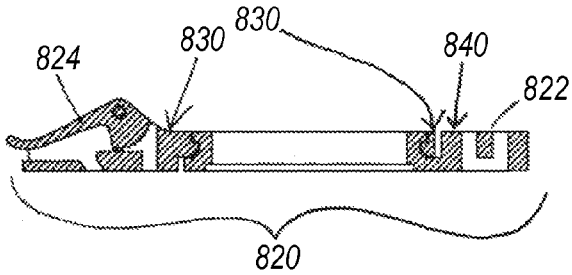
FIG. 11 shows a centerline cross sectional view of a multi rotational coupler.

FIG. 11 is a centerline cross sectional view of the multi rotational coupler base unit 820.

FIGS. 12A-12C show a cross sectional view of the multi rotational coupler connector 810. In FIGS. 8A and 8B, and FIGS. 13A and 13B, a left push rod 802, and a right push rod 804 are illustrated. The push rods 802, and 804 protrude from the main body of the connector unit at one end, and at the other end feature a cam. The cam portion engages a cam on the locking pin 806. When the two push rods are depressed by the user in the manner illustrated in FIG. 13B the cam surfaces of the push rods engage the cam surfaces on the locking pin causing the locking pin to move into the body of the connector 1300. This motion recesses the locking pin thus allowing the entire connector component 810 to be disengaged from the base component 820. When the push rods are not being depressed by the user a spring 1302 causes the locking pin 806 to return to its un-recessed state.

In FIGS. 12A-12C a centerline cross sectional view of the multi rotational coupler connector 810 and base unit 820 is shown at 90 degrees to the views shown in FIG. 11 and FIG. 13. The motion for engaging the components causes the locking pin 806 to push against the base unit 820 thus recessing it. The locking pin features a ramped portion to aid in this action. Once the locking pin is recessed, a hook bead 808 is able to slide under the base unit 820 as shown in FIG. 12C. With the connector fully seated, the spring 1302 causes the locking pin to return to its un-recessed state thus resulting in a fully engaged state of the multi rotational coupler between the base unit 820 and the connector 810.

The invention claimed is:

1. A quick-release buckle, comprising:

a first component including a first arcuate portion, and including a raised portion having a second arcuate portion, the raised portion is hingeably connected to the first component; and a second component including a first circular portion and a second circular portion wherein a radius of the first circular portion is greater than a radius of the second circular portion;

wherein the first circular portion mates with the first arcuate portion to provide a releasable lock between the first and second components, with the second arcuate portion rotatably engaged with the second circular portion;

wherein the first and second arcuate portions are substantially circular;

further comprising a first center point on the first component and a second center point on the second component, wherein the first center point and the second center point overlap, defining a common axis of rotation between the first and second components;

wherein the second component is planarly offset from the first component, allowing unimpeded and continuous rotation about the common axis of rotation; and wherein the second component further comprises a mounting structure for a strap, the mounting structure being offset axially and planarly from a mating location between the first arcuate portion and the first circular portion, such that the mounting structure is rotatable throughout a full rotation without interference from the first component.

2. The quick-release buckle of claim 1, wherein the second component is selectively released from the first component by depressing the raised portion along an axis perpendicular to a base of the first component.

3. The quick-release buckle of claim 1, wherein the first component is a female component, and the second component is a male component, such that the second component is received by the first component.

4. The quick-release buckle of claim 1, wherein the mounting structure is a bar having a length and a width, and the length is longer than a circumference of the first arcuate portion.

5. A method of fabricating a quick-release buckle, comprising:

attaching a female component to a bag, the female component including a first arcuate portion with a first dimension measured from a first center point to a corresponding outer first peripheral edge, and including a raised portion having a second arcuate portion that includes a second dimension measured from a second center point to a corresponding outer second peripheral edge, the second dimension being less than the first dimension, the raised portion is hingeably connected to the female component; and attaching a male component to a strap that includes a first circular portion and includes a second circular portion having a radius that is smaller than a radius of the second arcuate portion;

wherein the first circular portion mates with the first arcuate portion to provide a releasable lock between the female and male components, with the second arcuate portion rotatably engaged with the second circular portion;

wherein the first and second arcuate portions are substantially circular;

wherein the first center point and the second center point overlap, defining a common axis of rotation between the female and male components;

wherein the male component is planarly offset from the female component, allowing unimpeded and continuous rotation about the common axis of rotation; and wherein the male component further comprises a mounting structure offset axially and planarly from a mating location between the first arcuate portion and the first circular portion, such that the mounting structure is rotatable throughout a full rotation without interference from the female component.

6. The method of claim 5, wherein the male component is decoupleable from the female component by depressing the raised portion along an axis perpendicular to the plane of the female component.

7. The method of claim 5, wherein the mounting structure is a bar having a length and a width, and the length is longer than a circumference of the first arcuate portion.

8. A strapping system for a bag that includes a quick-release buckle, the quick-release buckle comprising:

a female component attached to the bag, the female component including a first arcuate portion protruding axially from a base of the female component and having a first dimension measured from a first center point to a corresponding outer first peripheral edge, and including a portion inclined relative to the base of the female component and having a second arcuate portion including a second dimension measured from a second center point to a corresponding outer second peripheral edge, the second dimension being less than the first dimension, the second arcuate portion hingeably connected to the female component; and a male component attached to a strap of the strapping system, and including a first circular portion protruding from a base of the male component, and a second circular portion concentric and interior to the first circular portion to form a protruding ring;

wherein the first semi-circular portion engages the first circular portion in a rotatable fashion, and the second semi-circular portion engages the second circular portion, creating a releasable lock between the male and female components; and wherein the male component further comprises a bar for mounting the male component to the strap, the bar being offset axially from a location where the second semi-circular portion mates with the second circular portion such that the bar is rotatable throughout a full rotation without interference from the female component.

9. The system of claim 8, wherein the male component is decoupled from the female component by depressing the inclined portion in an axial manner orthogonal to the base of the female component.

10. The system of claim 8, wherein the base of the female component and the base of the male component are offset in a planar fashion, allowing an unimpeded and continuous rotational motion about a common axis of rotation.

11. The system of claim 8, wherein the protruding ring has a conical exterior surface and a cylindrical interior surface.

* * * * *